United States Patent [19]

Slosiar

[11] 3,971,964

[45] July 27, 1976

[54] CYLINDRIC GRID ELECTRODE STRUCTURE FOR ELECTRONIC TUBES COMPRISING CARBON FILAMENTS COATED WITH PYROLYTIC GRAPHITE

[75] Inventor: Julius Slosiar, Chavannes-pres-Renens, Switzerland

[73] Assignee: BBC Brown Boveri & Company Limited, Baden, Switzerland

[22] Filed: Oct. 21, 1974

[21] Appl. No.: 516,761

[30] Foreign Application Priority Data

Nov. 7, 1973 Switzerland ..... 15649/73

[52] U.S. Cl. ..... 313/355; 313/348

[51] Int. Cl.[2] ..... H01J 1/48; H01J 19/42

[58] Field of Search ..... 313/348, 355, 107; 117/228, DIG. 11

[56] References Cited

UNITED STATES PATENTS

| | | | |
|---|---|---|---|
| 2,264,735 | 12/1941 | Baker et al. | 313/348 |
| 2,513,387 | 7/1950 | Wei | 313/107 |
| 2,946,915 | 7/1960 | Haase | 313/348 |
| 3,304,458 | 2/1967 | Langer et al. | 313/350 |
| 3,465,400 | 9/1969 | Polese | 313/348 |

OTHER PUBLICATIONS

Schmidt et al., "Filamentous Carbon and Graphite," Tech. Report AFML-TR-65-160, 8-1965, Air Force Materials Lab., Wright Patterson Air Force Base, Ohio, pp. 1-3, 15-16, 22, 24-30, 33-35.

*Primary Examiner*—John K. Corbin
*Assistant Examiner*—Wm. H. Punter
*Attorney, Agent, or Firm*—Pierce, Scheffler & Parker

[57] ABSTRACT

A cylindric grid electrode for electronic tubes formed by a set of carbon threads or filaments which have been coated with pyrolytic graphite. The coated carbon threads or filaments can be arranged in various configurations within the superfices of the cylinder such as in circumferentially spaced relation parallel to the cylindric axis alone, or in combination with another set of the coated threads or filaments located in spaced relation perpendicular to the axis or obliquely thereto and which overlay the first set and are soldered to the latter at the points of intersection. The coated carbon threads or filaments may also be arranged in two sets of helices oblique to the cylindric axis and which criss-cross and are soldered together at their points of intersection.

2 Claims, 6 Drawing Figures

CYLINDRIC GRID ELECTRODE STRUCTURE FOR ELECTRONIC TUBES COMPRISING CARBON FILAMENTS COATED WITH PYROLYTIC GRAPHITE

This invention is directed to an improved construction for a grid electrode for electronic tubes and to a novel method for the manufacture of such grid electrode.

It is already known to employ tubular electrodes, consisting of electro-graphite, in the form of a slotted hollow cylinder, its slots extending obliquely to the cylindrical lines of the hollow cylinder.

Experience has shown that such grid arrangements, especially if used for high-vacuum tubes, have disadvantages, limiting their technological application. Grid configurations made from hollow cylinders are usually produced by material-removing techniques of operation, such as grinding, milling or supersonic processes, whereby the dimensions of the grid-shaped slots, that is the width, distance and thickness of the webs, need to be constructed in such manner that the desired tube characteristics will be met.

The web dimensions are usually in the magnitude of some tenths of a millimeter. Assuming the utilization of very fine and precise machining methods, the lower limits of web dimensions will be determined by the granulation of the material because break-aways will occur during the processing when the web dimensions come close to the magnitude of the granulation. Therefore such grid systems can be produced only up to a certain lower limit concerning their web dimensions, subject to the size of granulation of the specific graphite being used. Another disadvantage is caused by the fact that grid structures, formed by intersecting radial and longitudinal webs, possess points of intersection with a more or less wide radius of curvature, due to tool settings, thus reducing the clear grid surface and requiring a corresponding correction by reduction in web width which, however, will not be feasible if the web dimensions have already reached their lowest limit.

Grid arrangements which comprise metallic wires and rods, or which are made of perforated metallic hollow cylinders, are not subject to these disadvantages, and in order to utilize the advantageous characteristics of carbon for such grid systems, a coating with pyrolytic graphite is called for.

High-temperature metals such as tungsten, molybdenum or tantalum are the most appropriate carrier materials for such purpose in the case of high powered, i.e. transmitter, tubes. Such materials will form carbides in the presence of carbons and under thermal conditions as required by pyrolytic processes, but will become embrittled as a result thereof, thereby impairing the shock resistance of such grid arrangements to a great extent, unless intermediate layers of non-carbide-forming materials substances are incorporated to act as a hindrance to diffusion, but such substances will have adhesion problems, difficult to control. Also, the coating of grids, made of molybdenum or tungsten wires with pyrolytic graphite, can lead to separations and/or irreversible grid deformations under operating conditions due to the difference in thermal expansion by the core and layer materials.

The use of electro-graphite is particularly advantageous for economic reasons because it can be machined easily, has a low weight, good dimensional stability and is relatively inexpensive.

Also, electro-graphite has a wide field of application in the electronic tube technology because of its high radiation, ease of de-gasification, low vapor pressure at high sublimation temperature and high work function, low secondary emission as well as relatively efficient electric and thermal conductivity.

The principal object of this invention is to provide an improved construction for a grid electrode for electronic high-power, i.e. transmitter, tubes which avoids the disadvantages, discussed above, of the known designs and constructions.

The grid electrode proposed by the invention is characterized by the fact that the portion of the electrode, which forms the grid proper, consists of carbon threads or filaments which are completely coated with pyrolytic graphite.

The advantages for using carbon threads or filaments are obvious. As in the case of metallic wires, the diameter of the threads or filaments being used can be dimensioned in a precise and simple manner to meet the electrical requirements without incurring an undesirable embrittlement of the carrier material by carbide formation due to subsequent pyrolysis as will occur in the case of metallic carriers or difficulties in adhesion, connected with the inclusion of diffusion-preventing substances.

The dimensions of the grid webs are not limited by tool design and/or quality of the graphite as in the case of mechanically machined graphite, hollow cylinders.

It will be advisable in the case of some intended uses, to arrange the carbon threads or filaments, coated with pyrolytic graphite, in such manner that they extend within the superficies of the cylinder equidistant from each other and parallel to the longitudinal axis of this cylinder. Also, it can be advantageous if the carbon threads or filaments, extending axially parallel and being coated with pyrolytic graphite, are surrounded by other carbon threads of filaments which are coated with pyrolytic graphite and extend in ring or helical form within the superfices of the cylinder, and are connected at their points of intersection in a fixedly and electrically conducting manner.

It can furthermore be advantageous if the carbon threads or filaments, coated with pyrolytic graphite, form intersecting, helically-running groups, their points of intersection being fixedly interconnected in such manner that they are electrically conducting.

It will be advantageous to solder together the carbon threads or filaments, coated with pyrolytic graphite at their points of intersection. The solder can comprise, for example, 35% of Au, 35% of Ni and 30% of Mo.

A further object of the invention is the provision of an advantageous method for the manufacture of the grid electrode proposed by the invention, its characteristics being that the carbon threads or filaments, coated with pyrolytic graphite, are fastened with one end to a first supporting part, that the coated carbon threads or filaments are then subjected to a specific tensional stress, and finally fixedly connected to a second supporting part spaced from the first supporting part which satisfies the working condition of the grid electrode.

The invention will now be explained in detail and is illustrated by the accompanying drawings which show three different embodiments thereof.

Figure 1:
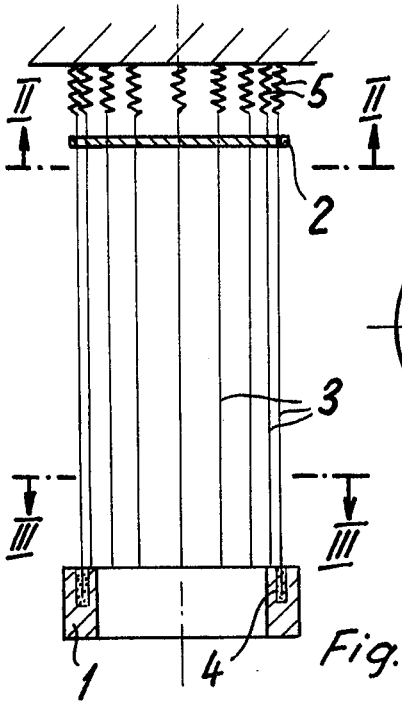
FIG. 1 shows a method for the manufacture of an embodiment of the grid electrode in accordance with the invention.
Figure 2:
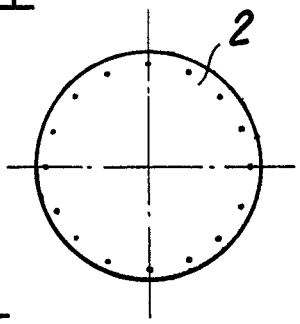
FIG. 2 is a transverse sectional view along line II—II in FIG. 1.
Figure 3:
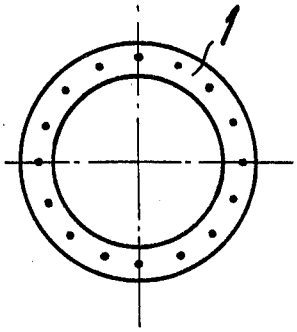
FIG. 3 is also a transverse sectional view along line III—III in FIG. 1.

Carbon filaments (C filaments or C-threads) ae produced industrially by the carbonization of organic polymerous filaments at temperatures ranging from 200° to 400° C, followed by a high-temperature treatment. The products are amorphous carbon or graphite, depending on the high-temperature treatment. Filaments made from cellulose, polyacrylonitryl or rayon can serve, among others, as starting materials.

Such carbon filaments possess a very high tensile strength but a very low shear strength and will break under light lateral pressure. The carbon filaments are now completely coated with a layer of pyrographite with good adhesion, thus alleviating the disadvantageous feature in a satisfactory manner. Tests have shown that pyrographite coatings with a thickness between 30 and 40 $\mu$m do offer a sufficient strengthening effect.

The pyrolytic precipitation can be accomplished, for example, at a temperature of 2,000° C under a flowing benzol-hydrogen atmosphere, with a mixing ratio of benzol to hydrogen = 0.25 : 5.0, resulting in a 11 $\mu$m per minute rate of growth of the pyrolytic layer at constant filament temperature. The use of the change in flow method, which means that the pyrolytic process is carried out at increasing filament temperature, did not result in any basic differences as to adhesion and structure of the pyrolytic layer, but microscopic thermo-fissures were detected within the pyrolytic layer. At constant filament temperature the rate of growth of the pyrolytic layer was found to be faster by a factor of 3 than in the case of the pyrolytic process carried out at increasing filament temperature, but in the case of the process using constant filament temperatures there occur certain starting problems.

Pyrographite is produced by thermal decomposition of gaseous hydrocarbons. Pyrographite is characterized by its columnar structure and the anisotropy, prominent among its characteristics. The growth of the columns takes place vertically to the substratum and vertically to the hexagonal crystallographic plane, designated as *c*-direction.

In the *a*-directions, that is parallel to the hexagonal crystallographic plane or to the substratum, the columns are tightly packed. The fineness of the columnar structure is determined, among other factors, to a great degree by the character of the substrate surface.

The anisotropic ratio determining the thermal conductivity ($\lambda a/\lambda c$) amounts to approximately 100, and approximately 1,000 for the electrical conductivity ($\chi a/\chi c$).

The pyrolytic process is carried out most expediently at temperatures ranging approximately from 1,600° to 2,000° C, and it will be most advantageous to produce pyrographite layers on the carbon filaments with a thickness of approximately 30 to 40 $\mu$m.

The grid components, shown in FIG. 1, are manufactured by fixing precisely the ring-shaped supporting part 1 and the disk-shaped supporting part 2 by means of a, not illustrated, mounting templet. To make possible the placement of the carbon threads or filaments 3, forming the grid and being completely coated with pyrolytic graphite, at equal distances from each other within the superficies of a cylinder and parallel to the longitudinal axis of this cylinder, the two supporting parts 1 and 2 are provided with a cylindric array of uniformly circumferentially spaced bores 4, which extend parallel to the longitudinal axis of the cylinder and which will accommodate the coated carbon threads or filaments 3.

The blind bores 4 located in the lower supporting part 1 are then filled with a fine-grained solder powder, and the threads or filaments are soldered at one end into these holes by use of high frequency induced currents under a vacuum or an inert atmosphere. Thereupon, the filaments or threads 3 are placed under tensile stress by springs 5, fastened to their opposite ends. The through bores 4 within the upper supporting part 2 are then covered with soldering powder, and the tensioned filaments or threads 3 are then soldered to the upper supporting part 2 in the same manner as explained above. The filaments or threads, coated with pyrolytic graphite, are thus under a precisely set stress when the grid electrode is fully assembled. A powder, comprising for example 35% of Au, 35% of Ni and 30% of Mo, can be used as the soldering material.

Figure 4:
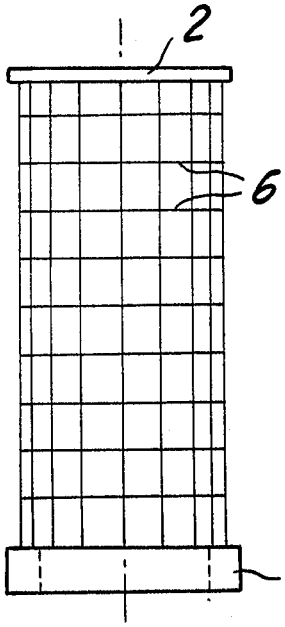
FIGS. 4 to 6 are views in side elevation of three different embodiments of grid electrodes in accordance with the invention for tubes with different characteristics.

FIG. 4 shows a cylindric embodiment of a grid electrode where a first set of carbon threads or filaments 3, coated with pyrolytic graphite and extending axially parallel is surrounded by a second set of parallel spaced carbon threads or filaments 6, also coated with pyrolytic graphite which extend in ring form within the superfices of the cylinder transverse to the axis thereof, the two sets 3 and 6 being connected at their points of intersection fixedly and in an electrically conducting manner by soldering.

Figure 5:
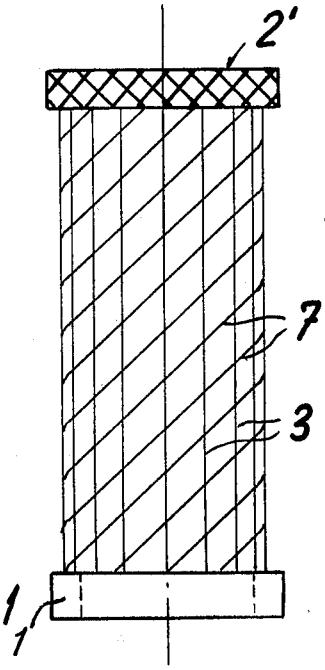

The cylindric embodiment of a grid electrode, shown by FIG. 5, uses a lower, annularly shaped supporting part 1, and an upper supporting part 2′, designed in the form of a cylindrical grid head with grid head cover, whereby a first set of carbon threads or filaments 3, coated with pyrolytic graphite and extending axially parallel, is surrounded by a second set of carbon threads or filaments 7, also coated with pyrolytic graphite, which extends in helical form within the superfices of the cylinder, the two sets being connected at their points of intersection fixedly and in an electrically conducting manner by soldering.

Figure 6:
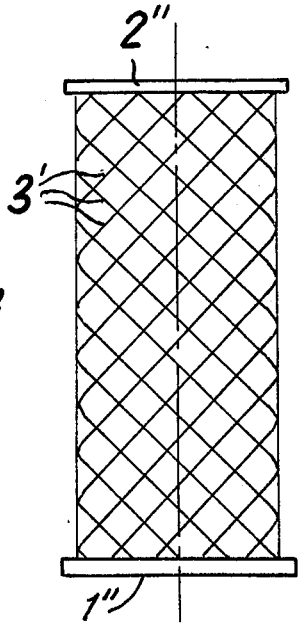

FIG. 6 shows still another example of a cylindric grid electrode, where the lower as well as the upper supporting parts 1″ and 2″ are designed in the shape of a disk. The carbon threads or filaments 3, coated with pyrolytic graphite, form two groups 3′ of helically extending lines, crossing each other, the two groups being connected at their points of intersection fixedly and in an electrically conducting manner by soldering.

I claim:

1. A grid electrode structure for electronic transmitter tubes characterized by the fact that the portion thereof which constitutes the grid proper consists of carbon in thread or filamentary form which is completely covered by a layer of pyrolytic graphite.

2. A grid electrode structure for electronic tubes as defined in claim 1 wherein the carbon threads or filaments consist of electro-graphite.

* * * * *